US005180256A

United States Patent [19]

Krings

[11] Patent Number: 5,180,256

[45] Date of Patent: Jan. 19, 1993

[54] SUPPORT DEVICE FOR LINING A DITCH

[75] Inventor: Josef Krings, Heinsberg, Fed. Rep. of Germany

[73] Assignee: Teska Verbautechnik GmbH, Oberhausen, Fed. Rep. of Germany

[21] Appl. No.: 846,262

[22] Filed: Feb. 28, 1992

[30] Foreign Application Priority Data

Mar. 2, 1991 [DE] Fed. Rep. of Germany ..... 4106698
Apr. 8, 1991 [DE] Fed. Rep. of Germany ..... 4111266

[51] Int. Cl.[5] ..... E02D 17/08
[52] U.S. Cl. ..... 405/282; 405/272
[58] Field of Search ..... 405/258, 272, 274, 276, 405/280, 282, 283

[56] References Cited

U.S. PATENT DOCUMENTS

| | | | |
|---|---|---|---|
| 4,099,386 | 7/1978 | Sagasta | 405/282 X |
| 4,345,857 | 8/1982 | Krings | 405/282 |
| 4,421,440 | 12/1983 | Scheepers | 405/282 |
| 4,993,880 | 2/1991 | Collins | 405/283 |
| 5,096,334 | 3/1992 | Plank | 405/283 |

*Primary Examiner*—David H. Corbin
*Attorney, Agent, or Firm*—Collard & Roe

[57] ABSTRACT

A support device for lining a ditch which is supported by braces. The support device has an inner plate and an outer plate parallel to and facing the inner plate. A frame is provided which has an upper cross bar, a lower cross bar and side bars placed between and in contact with the plates at their periphery. The side bars include brace connection means for releasably engaging the braces. Longitudinally extending trapezoidal-shaped webs are provided on each plate. The webs each have two sides and a top which is parallel to each plate. The distance between adjacent webs along each plate is approximately equal to the width of the top. The webs on the inner plate are offset from the webs on the outer plate so that the webs on the plates matingly interconnect. The tops are in contact with the facing sheet plate and the sides of adjacent webs are parallel and in contact with each other. Reinforcement pipes extend from the upper cross bar through the sides of the webs to the lower cross bar in a direction perpendicular to the longitudinal direction of the webs.

5 Claims, 3 Drawing Sheets

SUPPORT DEVICE FOR LINING A DITCH

BACKGROUND OF THE INVENTION

1. Field of the Invention

The present invention relates to a support device for lining ditches. More particularly, it relates to such lining plates which line opposite walls of a ditch and are held apart by braces Each lining plate is formed from two parallel cover sheet plates and web elements which are arranged in the longitudinal direction of the lining plate, i.e., longitudinal direction of the ditch. Reinforcement pipes pass through the web elements perpendicular to their longitudinal axis. A plate frame including an upper cross bar, a bottom cross bar and side bars is located between the lining plates.

2. The Prior Art

A support device is disclosed in German Patent DE 29 48 458 B1.

An essential requirement of modern ditch construction is to cause the smallest possible ditch profile. With known support devices, a relatively wide ditch profile must be provided. This is because the attachment and guide parts which project from the inside wall of the lining plates narrow the area of the ditch in which a canal or pipeline is to be installed. Furthermore, the design of the known lining plates requires the use of relatively thick and heavy plates, in order to satisfy the static strength requirements.

SUMMARY OF THE INVENTION

It is an object of the present invention to provide a support device for lining ditches which is structured in such a way that it has the required static strength, but at a lesser wall thickness, and at the same time makes it possible to maintain a low width profile for the ditch.

These and other related objects are achieved according to the invention by a support device for lining a ditch which is supported by braces. The support device has an inner plate and an outer plate parallel to and facing the inner plate. A frame is provided which has an upper cross bar, a lower cross bar, and side bars placed between and in contact with the plates at their periphery. The side bars include brace connection means for releasably engaging the braces.

Longitudinally extending trapezoidal-shaped webs are located on each plate. The webs each have two sides and a top which is parallel to each plate. The distance between adjacent webs along each plate is approximately equal to the width of the top. The webs on the inner plate are offset from the webs on the outer plate so that the webs on the plates matingly interconnect, whereby the tops are in contact with the facing sheet plate and the sides of adjacent webs are parallel and in contact with each other. Reinforcement pipes extend from the upper cross bar to the sides of the webs to the lower cross bar in a direction perpendicular to the longitudinal direction of the webs.

The side bars include a first, a second and a third vertically extending U-shaped rail each having two arms and a base. The second rail has its arms facing the ditch interior The first and third rails are located on either side of the second rail and have their arms facing and connected to the arms of the second rail. The brace connection means includes the second rails in which the braces can be securely locked.

In a preferred embodiment of the invention, the tops of the webs are glued to the facing sheet plate.

In an alternate embodiment, a support device for lining a ditch is provided in which the device is supported by braces. An inner plate including longitudinally-extending inner plate members is provided as well as an outer plate parallel to and facing the inner plate. A frame is included having an upper cross bar, a lower cross bar and side bars placed between and in contact with the plates at their periphery. The side bars include brace connection means for releasably engaging the braces. Longitudinally-extending trapezoidal-shaped webs are placed on the outer web. The webs each have two sides and a top which is parallel to the outer plate. The distance between adjacent webs along the outer plate is approximately equal to the width of the top. The plane area between adjacent tops is filled by the inner plate members, and the plane area between the tops and the side bars is filled by the inner plate members. The inner plate members and the tops cooperatively form the inner plate. Reinforcement pipes extend from the upper cross bar through the sides of the webs to the lower cross bar in a direction perpendicular to the longitudinal direction of the webs.

The side bars include a first, second, and third vertically-extending U-shaped rail, each having two arms and a base. The second rail has its arms facing the ditch interior. The first and third rails are located on either side of the second rail and have their arms facing and connected to the arms of the second rail. The brace connection means includes the second rail in which the braces can be securely locked.

BRIEF DESCRIPTION OF THE DRAWINGS

Other objects and features of the present invention will become apparent from the following detailed described considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
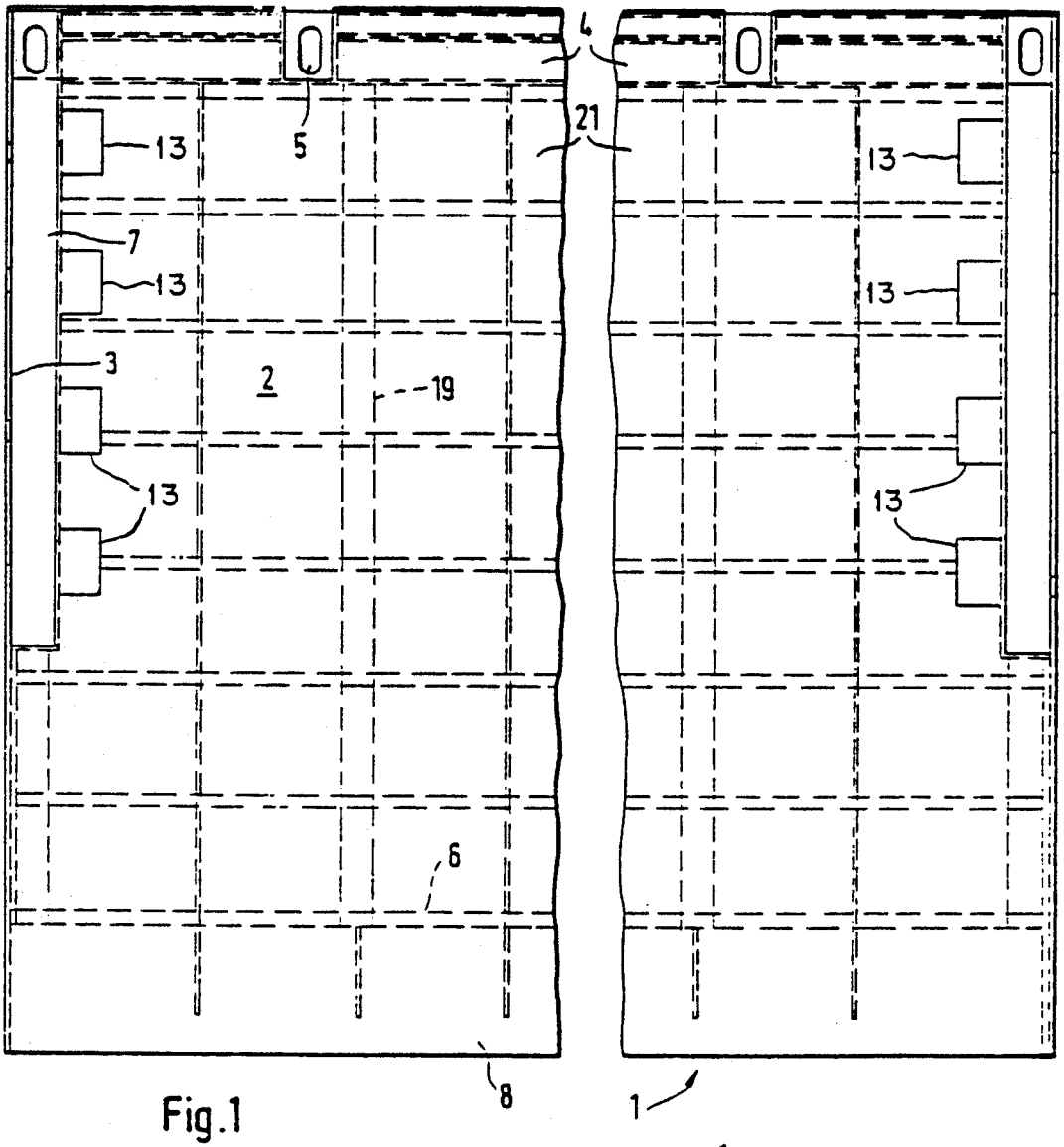
FIG. 1 is a partial side elevational view of a lining plate according to the invention.
Figure 2:
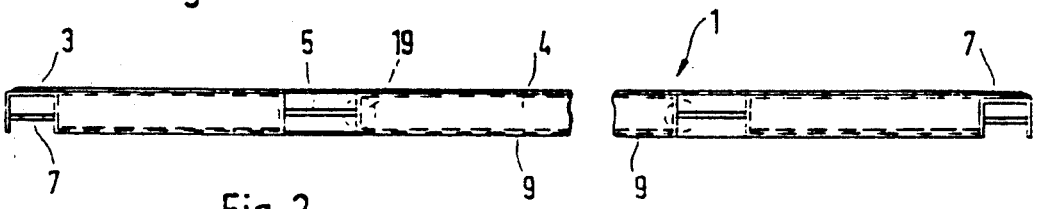
FIG. 2 is a top plan view of the linig plate.

Turning now in detail to the drawings and, in particular, FIGS. 1 and 2, there is shown a lining plate 1 for lining ditches structured as a "shaft plate." Pairs of shaft plates are held apart by braces to form a lining along opposite walls of a ditch.

Lining plate 1 includes a plate element 2 and a plate frame 3. Plate frame 3 includes a top cross bar 4, which is provided with eyes 5 which can accommodate a crane hook. Plate frame 3 also has a bottom cross bar 6 to which a blade 8 can be attached, as well as side bars 7, which frame the edges of plate element 2.

As FIG. 2 shows, side bars 7 are U-shaped rails which serve to hold support shoes (not shown for reasons of clarity) of the braces which keep the lining plates 1 spaced apart. In contrast to conventional lining plates, these side bars 7 lie in the general plane of the lining plate, so that the holder rail for the support shoes is not in front of lining plate 1 facing the ditch interior. Lining plate 1 has rectangular recesses 13 for holder bolts (not shown for reasons of clarity) for support shoes of the braces.

Figure 3:
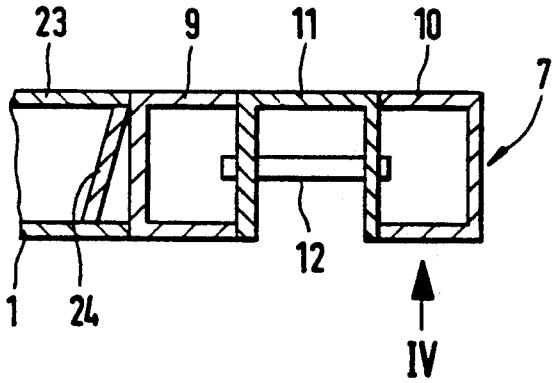
FIG. 3 is an enlarged cross-sectional view of an end section of the lining plate taken along the line III—III of FIG. 4.
Figure 4:
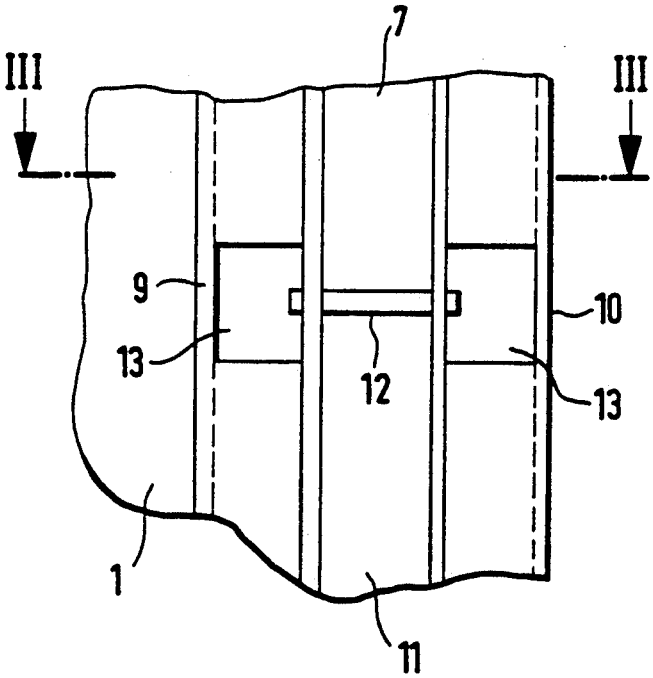
FIG. 4 is an enlarged side elevational view of an end section of the lining plate.

As shown in FIGS. 3 and 4, side bars 7 can also include of three U or C-shaped rails 9, 10 and 11. Rails 9, 10 are welded to the arms of another U or C-shaped rail 11 which opens towards the ditch interior. Rails 9 and 10 have their arms facing each other. Rail 11 is sized in such a way that it is able to hold the support shoes (not shown for reasons of clarity) located at the ends of the braces, with a positive lock.

As FIG. 4 shows, the U or C-shaped rails 9, 10 can be provided with rectangular recesses 13 adjacent to where rail 11 has bores to hold holder bolts 12 for the support shoes.

Figure 6:
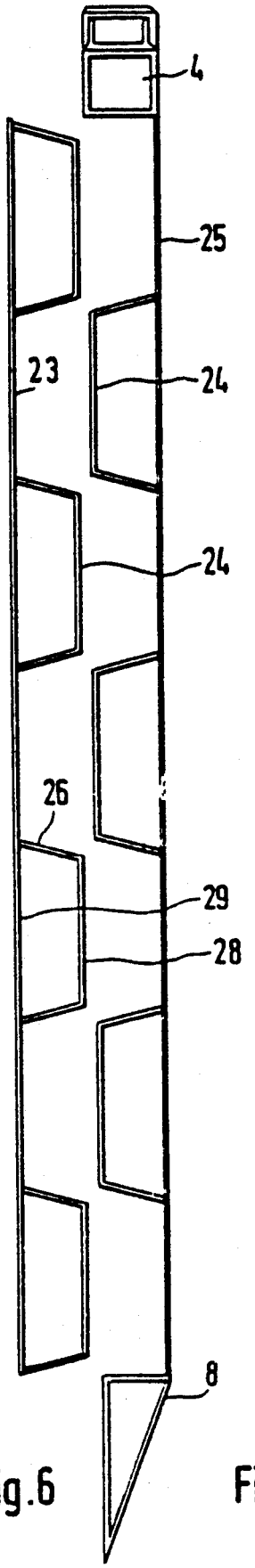
FIG. 6 is an exploded view of FIG. 5.
Figure 5:
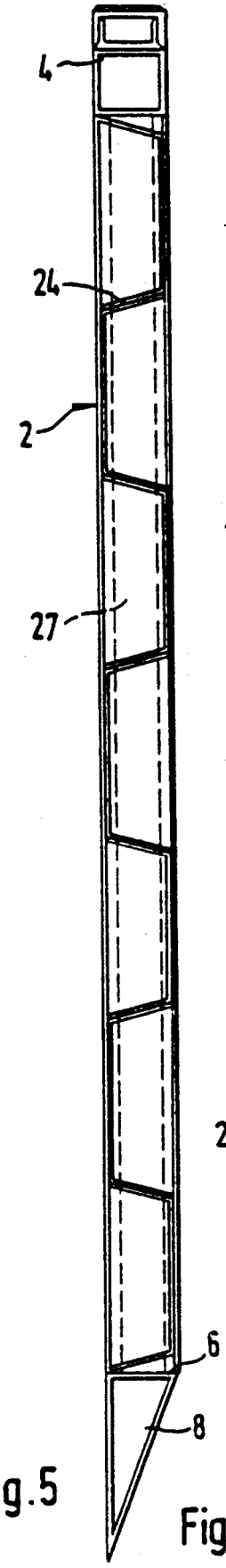
FIG. 5 is a perpendicular, enlarged, longitudinal cross-sectional view of the lining plate.
Figure 7:
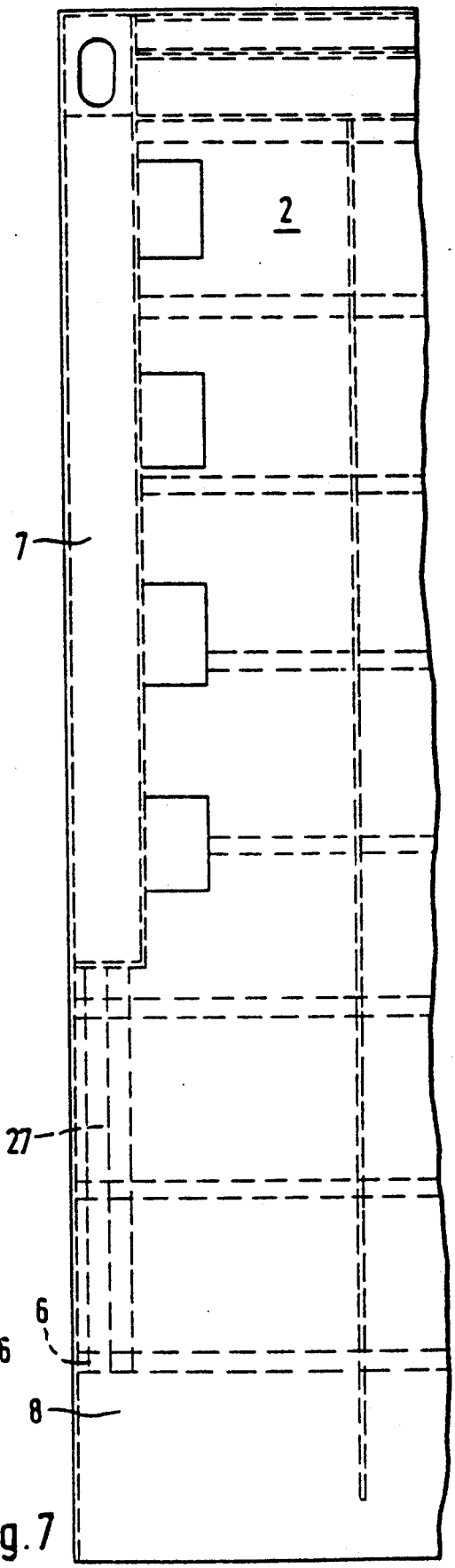
FIG. 7 is a partial side elevational view of the lining plate.

FIGS. 5 to 7 show details of a plate element 2 having a back cover sheet plate 23 facing the ditch wall. Web elements 24 made of sheet metal, folded or bent have a trapezoidal cross section and are attached, e.g. welded to sheet plate 23. Web elements extend in the longitudinal direction and are parallel to one another. A front cover sheet plate 25 is also provided with longitudinally extending web elements 24 which are parallel to one another. Web elements 24 of plates 23 and 25 are arranged offset relative to each other in such a way that they can be inserted into each other and rigidly connected. The plates are advantageously connected with adhesive, in order to avoid thermal distortions, and to ensure simpler production. Reinforcement pipes 27 extend through plate element 2 and through the side surfaces 26 of web elements 24, perpendicular to the longitudinal axes of web elements 24.

This embodiment has the advantages that there is a simple and inexpensive method to produce lining plates having strength and static values which exceed, by many times, those of known comparable lining plates. Thus, the dimensions and weight of the lining plates can be significantly reduced. Advantageously, more lining material can be transported with each truck load. Also, the required ditch profile thickness is also reduced.

Figure 8:
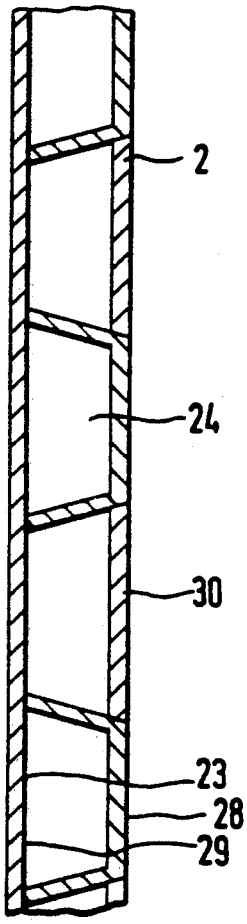
FIG. 8 is a cross-sectional view of another embodiment of a plate element.

As shown in FIG. 8, there is a second embodiment for the plate element 2. Cover sheet plate 23 which faces the ditch wall has longitudinally extending web elements 24, folded or bent with trapezoidal cross sections. Web elements 24 are parallel to one another. In this regard, this part of the structure corresponds to the left plate half in FIG. 6. Web elements 24 are arranged relative to one another in such a way that the distance between adjacent cover surfaces 28 is equal to the width base surface 29. Adjacent cover surfaces 28 are connected by sheet metal plates 30 welded onto them. This replaces plate 25 of FIGS. 5–7 with cover surfaces 28 of web elements 24. As in the other embodiment, the reinforcement pipes 2 extend through web elements 24.

An additional advantage of this embodiment is that a tremendous weight reduction is achieved. Furthermore, difficulties arising from the joining together of the plate parts according to the prior art are eliminated.

While several embodiments of the present invention have been shown and described, it is to be understood that many changes and modifications may be made thereunto without departing from the spirit and scope of the invention as defined in the appended claims.

What is claimed is:

1. A support device for lining a ditch, said device supported by braces, comprising:

an inner plate;

an outer plate parallel to and facing said inner plate;

a frame having an upper cross bar, a lower cross bar and side bars placed between and in contact with said plates at their periphery, said side bars including brace connection means for releasably engaging the braces;

longitudinally extending trapezoidal-shaped webs on each plate, said webs each having two sides and a top which is parallel to each plate, the distance between adjacent webs along each plate is approximately equal to the width of said top, said webs on said inner plate being offset from said webs on said outer plate so that said webs on said plates matingly interconnect, whereby said tops are in contact with the facing sheet plate, and said sides of adjacent webs are parallel and in contact with each other;

reinforcement pipes extending from said upper cross bar, through said sides of said webs to said lower cross bar in a direction perpendicular to the longitudinal direction of said webs.

2. The support device according to claim 1, wherein said side bars include a first, a second and a third vertically-extending U-shaped rail, each having two arms and a base, said second rail having its arms facing the ditch interior, said first and third rails being located on either side of said second rail, and having their arms facing and connected to said arms of said second rail, said brace connection means including said second rail in which the braces can be securely locked.

3. The support device according to claim 2, wherein said tops are glued to the facing sheet plate.

4. A support device for lining a ditch, said device supported by braces, comprising:

an inner plate including longitudinally-extending inner plate members;

an outer plate parallel to and facing said inner plate;

a frame having an upper cross bar, a lower cross bar and side bars placed between and in contact with said plate at their periphery, said side bars including brace connection means for releasably engaging the braces;

longitudinally-extending trapezoidal-shaped webs on said outer plate, said webs each having two sides and a top which is parallel to said outer plate, the distance between adjacent webs along said outer plate is approximately equal to the width of said top, the plane area between adjacent tops is filled by said inner plate members, and the plane areas between said tops and said side bars is filled by said inner plate members, wherein said inner plate members and said tops cooperatively form said inner plate; and reinforcement pipes extending from said upper cross bar, through said sides of said webs to said lower cross bar in a direction perpendicular to the longitudinal direction of said webs.

5. The support device according to claim 4, wherein said side bars include a first, a second and a third vertically-extending U-shaped rail, each having two arms and a base, said second rail having its arms facing the ditch interior, said first and third rails being located on either side of said second rail, and having their arms facing and connected to said arms of said second rail, said brace connection means including said second rail in which the braces can be securely locked.

* * * * *